US007331370B1

(12) United States Patent
Militello et al.

(10) Patent No.: US 7,331,370 B1
(45) Date of Patent: Feb. 19, 2008

(54) PROGRESSIVE RESISTANCE LIFTING MECHANISM FOR A WINDOW COVERING

(75) Inventors: David R. Militello, Rohnert Park, CA (US); Barry L. Shevick, Fair Oaks, CA (US); Robert L. Lathrop, III, Santa Clara, CA (US); Bruce R. Dendulk, Ripon, CA (US)

(73) Assignee: Shades Unlimited, Inc., Cotati, CA (US)

( * ) Notice: Subject to any disclaimer, the term of this patent is extended or adjusted under 35 U.S.C. 154(b) by 286 days.

(21) Appl. No.: 10/911,313

(22) Filed: Aug. 3, 2004

(51) Int. Cl.
*E06B 3/322* (2006.01)

(52) U.S. Cl. ..... 160/170; 242/381

(58) Field of Classification Search ..... 160/170, 160/171, 168.1 P, 168.1 R, 298, 299; 242/378.4, 242/373, 381.6, 381, 375.3; 185/39, 45; 188/268, 271
See application file for complete search history.

(56) References Cited

U.S. PATENT DOCUMENTS

| | | | | |
|---|---|---|---|---|
| 870,876 | A | 11/1907 | Fleming | |
| 1,220,881 | A | 3/1917 | Nelson | |
| 1,270,634 | A | 6/1918 | Lowe | |
| 2,307,095 | A | 1/1943 | Zaferakis | |
| 3,062,381 | A | 11/1962 | Maiden | |
| 4,271,893 | A | 6/1981 | McCluskey | |
| 4,373,569 | A | 2/1983 | Barettella | |
| 4,597,430 | A | 7/1986 | Marquez | |
| 4,836,265 | A | 6/1989 | Bussert | |
| 5,025,848 | A | 6/1991 | Prochaska | |
| 5,105,867 | A | 4/1992 | Coslett | |
| 5,158,127 | A | 10/1992 | Schumacher | |
| 5,279,473 | A | 1/1994 | Rozon | |
| 5,354,011 | A | 10/1994 | Rozon | |
| 5,676,415 | A | 10/1997 | Ament | |
| 5,706,876 | A | 1/1998 | Lysyj | |
| 5,762,281 | A | 6/1998 | Foley | |
| 5,915,442 | A | 6/1999 | Prosch | |
| 5,960,846 | A | 10/1999 | Lysyj | |
| 6,024,154 | A | 2/2000 | Wang | |
| 6,029,734 | A | 2/2000 | Wang | |
| 6,047,759 | A | 4/2000 | Lysyj | |
| 6,056,036 | A | 5/2000 | Todd | |
| 6,149,094 | A | 11/2000 | Martin | |
| 6,234,236 | B1 * | 5/2001 | Kuhar | 160/170 |
| 6,283,192 | B1 * | 9/2001 | Toti | 160/170 |
| 6,289,964 | B1 | 9/2001 | Colson | |
| 6,289,965 | B1 | 9/2001 | Ruggles | |
| 6,330,899 | B1 | 12/2001 | Ciuca | |
| 6,470,948 | B2 | 10/2002 | Yates | |
| 6,508,293 | B1 | 1/2003 | Huang | |

(Continued)

*Primary Examiner*—Blair M. Johnson
(74) *Attorney, Agent, or Firm*—Heisler & Associates

(57) ABSTRACT

A lifting mechanism is provided for a window covering which allows a bottom rail of the window covering to maintain a static position unless raised or lowered by a user. The lifting mechanism is included within either a top or bottom rail of the window covering. The lifting mechanism includes cords which pass from a rail including the lifting mechanism to a rail not including the lifting mechanism and about cord redirectors located within the rail including the lifting mechanism. The lifting mechanism includes spools and associated springs for gathering excess portions of the cord thereon. A progressive resister is coupled to the spools with the progressive resister providing different amounts of resistance to spool rotation depending on the amount of cord upon each spool.

44 Claims, 7 Drawing Sheets

U.S. PATENT DOCUMENTS 6,550,522 B1 * 4/2003 Lennon et al. ..... 160/168.1 R
6,571,853 B1 * 6/2003 Ciuca et al. ..... 160/192
6,575,223 B1 6/2003 Chung
6,601,635 B2 * 8/2003 Ciuca et al. ..... 160/170
6,644,372 B2 11/2003 Judkins
6,644,373 B2 11/2003 Palmer
6,644,375 B2 * 11/2003 Palmer ..... 160/84.04
6,675,861 B2 1/2004 Palmer
6,761,203 B1 7/2004 Huang
6,823,925 B2 * 11/2004 Militello et al. ..... 160/170
2002/0033241 A1 3/2002 Palmer
2002/0157796 A1 10/2002 Judkins
2003/0111191 A1 6/2003 Ciuca
2004/0094274 A1 5/2004 Judkins
2004/0154758 A1 8/2004 Cheng
2004/0177933 A1 * 9/2004 Hillman et al. ..... 160/170

* cited by examiner

PROGRESSIVE RESISTANCE LIFTING MECHANISM FOR A WINDOW COVERING

FIELD OF THE INVENTION

The following invention relates to lifting mechanisms for window coverings of various varieties. More particularly, this invention relates to lifting mechanisms for window coverings which automatically provide sufficient lifting force so that a bottom rail of the window covering will remain in a position where it is placed by a user until the bottom rail is again moved by a user to a new position, without requiring engaging or releasing of locking mechanisms through buttons, cords or other manually actuated locking mechanisms.

BACKGROUND OF THE INVENTION

Window coverings are provided in a wide variety of styles and configurations to both provide the function of at least partially occluding the passage of light through a window and enhancing an appearance of a room in which the window is located. Such window coverings can include shades which are typically continuous from a top rail at an upper end of the window to a bottom rail at a bottom end of the shade. Such shades can be in the form of a single layer of material or multiple layers of material and can be pleated or smooth, and can optionally include cellular "hive-like" cavities within the window covering structure itself. Window coverings also include blinds which are typically formed of separate slats of rigid or flexible material which either have a fixed angle or can be adjusted in angle to allow some light to pass through the separate slats within the blind.

The entire assembly mounted within the window is referred to as the window covering assembly. The portion of the window covering assembly which acts to occlude the passage of light is referred to as the window covering or as the window covering structure. The entire window covering assembly thus includes the top rail, the bottom rail and the window covering structure extending between the top rail and the bottom rail.

While window coverings can be of fixed size, window coverings are usually desirably adjustable so that the window can be blocked when desired or exposed, depending on the needs of the user. Various different prior art window covering adjustment systems are known. Most typically, cords are provided which extend from the bottom rail, through the window covering structure up to the top rail, and then continue on an exterior side of the window covering structure. A user grasps the cords and pulls the cords to raise the bottom rail towards the top rail and expose the window. The user releases the cord and the weight of the bottom rail causes the window covering to cover the window. Often locking mechanisms are also provided to assist in locking the bottom rail of the shade at a desired position.

Such external cord based window covering adjustment mechanisms are less than entirely satisfactory. The cords can become entangled with themselves or other structures, rendering the cords non-functional in adjusting the position of the window covering. The cords present a safety risk for infants and toddlers. Also, the locking mechanisms for locking the cord in the desired position so that the window covering bottom rail is positioned where desired is often difficult to use effectively and is prone to wearing out, so that the window covering is effectively stalled in either the fully open or fully closed position.

The deficiencies in external cord systems for adjusting window covering position have led to the development of "cordless" window coverings. For instance, see U.S. Pat. No. 6,644,375. Such cordless window coverings include cords which are internal, extending between the top rail and the bottom rail but with no external cords. Some such cordless blinds utilize locking mechanisms adjacent the top rail or the bottom rail which are typically in the form of buttons. When the bottom rail is to be raised to expose the window, one or more buttons are pushed and the bottom rail is raised. When the button is released, the shade remains in the selected position. When the bottom rail is to be lowered, the button(s) can again be pushed and the bottom rail repositioned before releasing the button(s) with the bottom rail in the new desired position. In at least one window covering, included in Published Application No. US-2004-0007333-A1, the bottom rail can be pulled down without requiring that the buttons be pushed. Only when the bottom rail is to be raised do the buttons need to be pushed.

Other prior art window coverings have height adjustment mechanisms which rely on some form of balancing of the bottom rail so that adjustment of the height of the shade is somewhat automatic. Instead of requiring that buttons be pushed, the bottom rail is merely repositioned to a desired position. The shade then remains balanced in the new position. For instance, see U.S. Pat. No. 6,571,853.

While such balanced cordless shades are taught in the prior art, such balanced cordless shades have heretofore required complex mechanisms which have exhibited various undesirable performance characteristics. In particular, such cordless balanced shades have typically included some form of cord collecting structure, such as a spool which has been biased, such as with a spring to cause the cord running from the bottom rail up to the cord collector to be encouraged onto the spool. As the bottom rail moves downward, the strength of the spring increases, making it difficult to cause the bottom rail to remain fixed in the lower position. At a minimum, the bottom rail is inclined to bounce somewhat and not remain solidly in a fully down position. When a weaker spring or other biaser is used, it has insufficient force to keep the bottom rail from falling down at least somewhat when the user desires that the window covering be entirely open.

Variable resistance springs have been attempted, as one solution to this problem. Various cord handling mechanisms have been utilized including one-way brakes and one-way cord movement retarders to discourage such undesirable bounce. With each of these solutions, a need remains for a simple and reliable lifting mechanism for a window covering which allows a user to easily adjust a position of the bottom rail of the window covering merely by grasping the bottom rail and positioning it where desired, with confidence that the bottom rail will remain precisely where it has been left until it is again moved by the user.

SUMMARY OF THE INVENTION

This invention provides a lifting mechanism for a window covering which facilitates a cordless window covering to be easily positioned as desired and easily repositioned, by merely placing a bottom rail of the window covering where the user desires it to be. The window covering includes a top rail and a bottom rail with a window covering suspended therebetween. At least one cord, and typically two cords extend between the top rail and the bottom rail. A cord collector is located within one of the rails with the cord coupled to the cord collector at the end of the cord adjacent the cord collector. The cord collector is coupled to a biaser which biases the cord collector in a direction encouraging the cord collector to collect the cord thereon. The cord is routed so that the weight of the shade counteracts the forces exerted by the biaser so that the cord remains stationary and hence the bottom rail of the window covering remains stationary, unless external forces are applied to the system.

Additionally, a progressive resister is coupled to the cord collector. The progressive resister adds a progressive amount of resistance to motion of the cord collector as a greater amount of cord is taken away from the cord collector. Thus, when the bottom rail is most distant from the top rail and the cord is mostly off of the cord collector, the progressive resister exerts a maximum resistance force against collection of the cord by the cord collector, in effect resisting the action of the biaser upon the cord collector. When the bottom rail is closer to the top rail and a greater amount of the cord is collected with the cord collector, a relatively lesser amount of resistance is exerted upon the cord collector by the progressive resister, so that action of the biaser upon the cord collector is opposed to a lesser extent. The action of the progressive resister allows the window covering to avoid the "bounce" phenomena associated with the biaser, such as a spring, exerting an excessive force upon the cord collector when the cord is a maximum amount away from the cord collector. The amount of resistance added by the progressive resister is thus correlated with the amount of cord collected with the cord collector and by correlation, the position of the bottom rail relative to the top rail.

When two cords are provided between the bottom rail and the top rail, preferably two cord collectors are provided with the two cord collectors preferably linked together so that they collect common amounts of cord simultaneously and release common amounts of cord simultaneously. Thus, the bottom rail remains parallel with the top rail at all times. The progressive resister preferably acts upon both cord collectors.

In a most preferred arrangement, the cord collectors are in the form of spools with the biasers in the form of separate helical springs associated with each of the cord collectors. The spools are coupled to gears which mesh with each other and with a resistance gear coupled to the progressive resister.

While the progressive resister could take different forms, in a most preferred embodiment, the progressive resister includes a threaded shaft coupled to the resistance gear and with a bottom plate adjacent the resistance gear and a top plate spaced from the bottom plate. The top plate and bottom plate are preferably configured to avoid rotation and with the top plate coupled to a key with a threaded hole upon the threaded shaft so that the top plate moves toward and away from the bottom plate when the resistance gear rotates. A spring is interposed between the top plate and the bottom plate so that when the top plate moves toward the bottom plate, the spring is compressed and the bottom plate exerts a relatively greater amount of force against the resistance gear. The bottom plate thus resists rotation of the resistance gear and the other gears meshed therewith, including the gears coupled to the spools.

OBJECTS OF THE INVENTION

Accordingly, a primary object of the present invention is to provide a window covering without any external cords and which can be adjusted in height easily and reliably.

Another object of the present invention is to provide an adjustable height window covering which has a bottom rail which remains in a position in which it is placed and which can be easily moved by grasping the bottom rail and moving the bottom rail to the position where desired.

Another object of the present invention is to provide a "cordless" window shade which can be adjusted in height without requiring manual actuation of a locking mechanism.

Another object of the present invention is to provide a window covering which has a bottom rail which remains parallel with a top rail at all times and which bottom rail can be easily positioned where desired relative to the top rail.

Another object of the present invention is to provide a window covering which is both free of any external cords and balanced so that the bottom rail can be positioned where desired without requiring actuation of any locking mechanisms, and which bottom rail avoids a "bounce" phenomena throughout a range of motion of the bottom rail.

Another object of the present invention is to provide a window covering which does not have any external cords and which is balanced, and can be easily cut to different widths without interfering with lifting mechanism performance.

Another object of the represent invention is to provide a window covering which is free of external cords and is balanced, and which exhibits reliable performance for a long duration and with heavy use.

Another object of the present invention is to provide a window covering which is free of external cords and balanced, and which can be readily manufactured from commonly available materials while still exhibiting reliable quality performance.

Other further objects of the present invention will become apparent from a careful reading of the included drawing figures, the claims and detailed description of the invention.

DESCRIPTION OF THE PREFERRED EMBODIMENT

Figure 1:
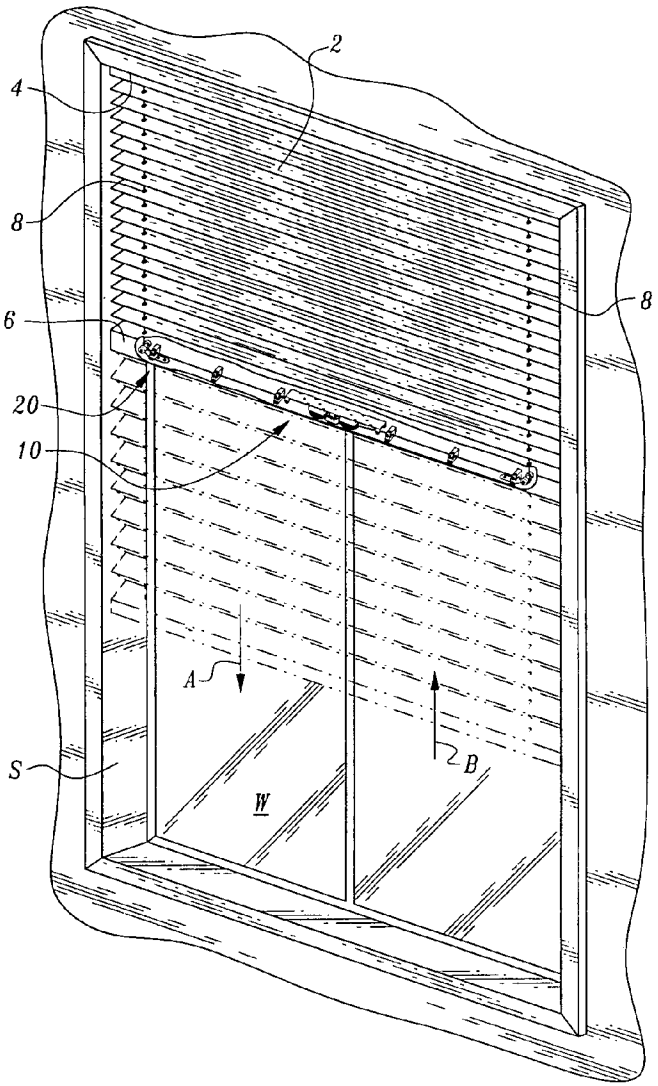
FIG. 1 is a perspective view of a window with a window covering according to this invention installed thereon, and with a lifting mechanism of the window covering shown located within a bottom rail of the window covering.

Referring to the drawings, wherein like reference numerals represent like parts throughout the various drawing figures, reference numeral 10 (FIGS. 1 and 6) is directed to a lifting mechanism for a window covering 2. The window covering 2 generally includes a top rail 4 parallel with and spaced from a bottom rail 6 with the window covering 2 structure extending between the top rail 4 and bottom rail 6. Cords 8 extend between the top rail 4 and the bottom rail 6. The lifting mechanism 10 acts upon the cords 8 within one of the rails 4, 6 so that the bottom rail 6 can maintain equilibrium wherever the bottom rail 6 is positioned by a user. In this way, a user can raise the bottom rail 6 (arrow B) or lower the bottom rail 6 (arrow A) to occlude the window W or expose the window W, with the bottom rail 6 conveniently remaining where it is left by the user.

Figure 3:
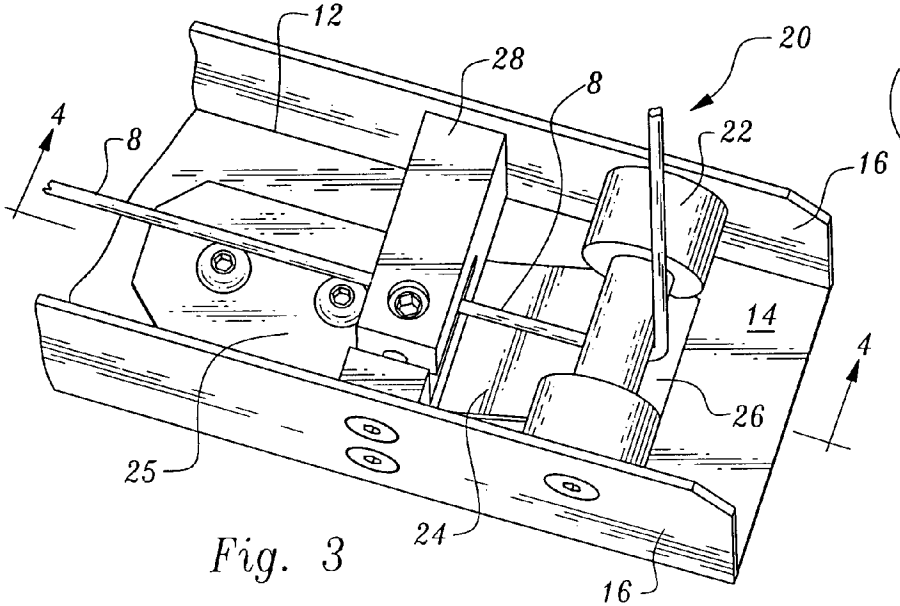
FIG. 3 is a perspective view of the cord redirector of this invention.
Figure 4:
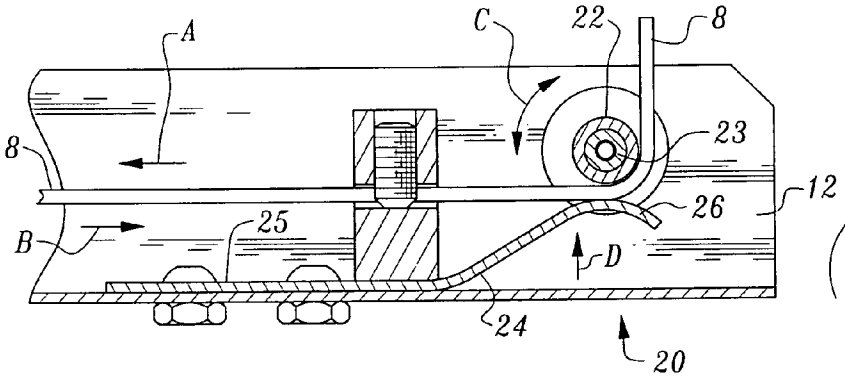
FIG. 4 is a full sectional view of the cord redirector of FIG. 3.
Figure 6:
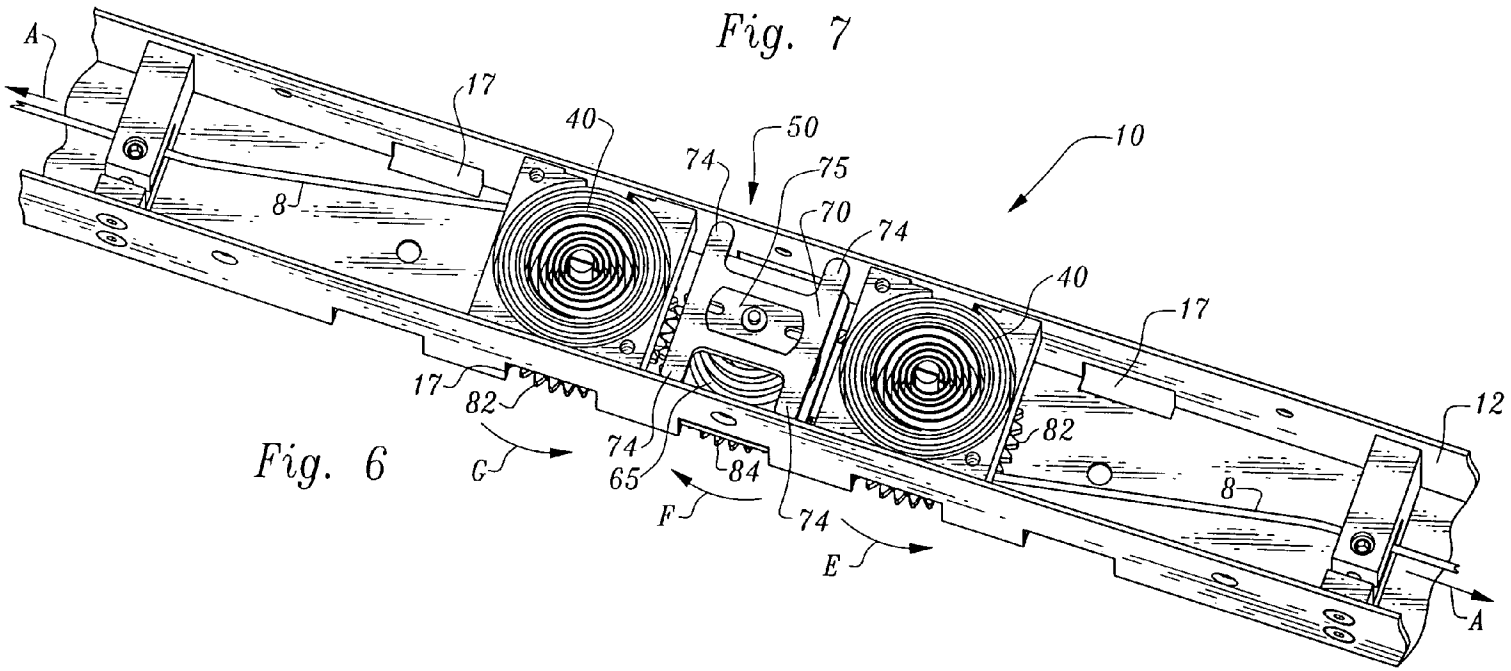
FIG. 6 is a perspective view of the lifting mechanism of this invention with a cover removed to reveal interior portions of the lifting mechanism.

In essence, and with particular reference to FIGS. 1, 3 and 6, basic details of the lifting mechanism 10 are described. The lifting mechanism 10 is preferably located within a central portion of the bottom rail 6 of the entire window covering assembly. The cords 8 extend out of the lifting mechanism 10 in opposite horizontal directions to cord redirectors 20 also within the bottom rail 6. The cord redirectors 20 redirect the cords from extending horizontally within the bottom rail 6 to extending substantially vertically up to the top rail 4.

The cords 8 interface with the lifting mechanism 10 through spools 30 which are configured to collect the cords 8 thereon and release the cords 8 therefrom, depending on the position of the bottom rail 6 relative to the top rail 4. Springs 40 are coupled to each of the spools 30. The springs 40 bias the spools 30 toward collecting the cords 8 upon the spools 30. The springs 40 thus counteract gravity forces acting upon the bottom rail 6 and tending to pull the cords 8 off of the spools 30.

A progressive resister 50 is provided which exerts progressively greater resistance to spool 30 rotation as progressively greater amounts of cord 8 are released from the spools 30. The progressive resister 50 thus acts against the forces exerted by the springs 40 upon the spools 30. Preferably the progressive resister 50 is coupled to the spools 30 through a gear set 80.

More specifically, and with particular reference to FIG. 1, details of the window covering 2 and associated structures are provided. The lifting mechanism 10 of this invention is included within an overall window covering assembly. The window covering assembly specifically includes the window covering 2 extending between the top rail 4 and the bottom rail 6.

Figure 13:
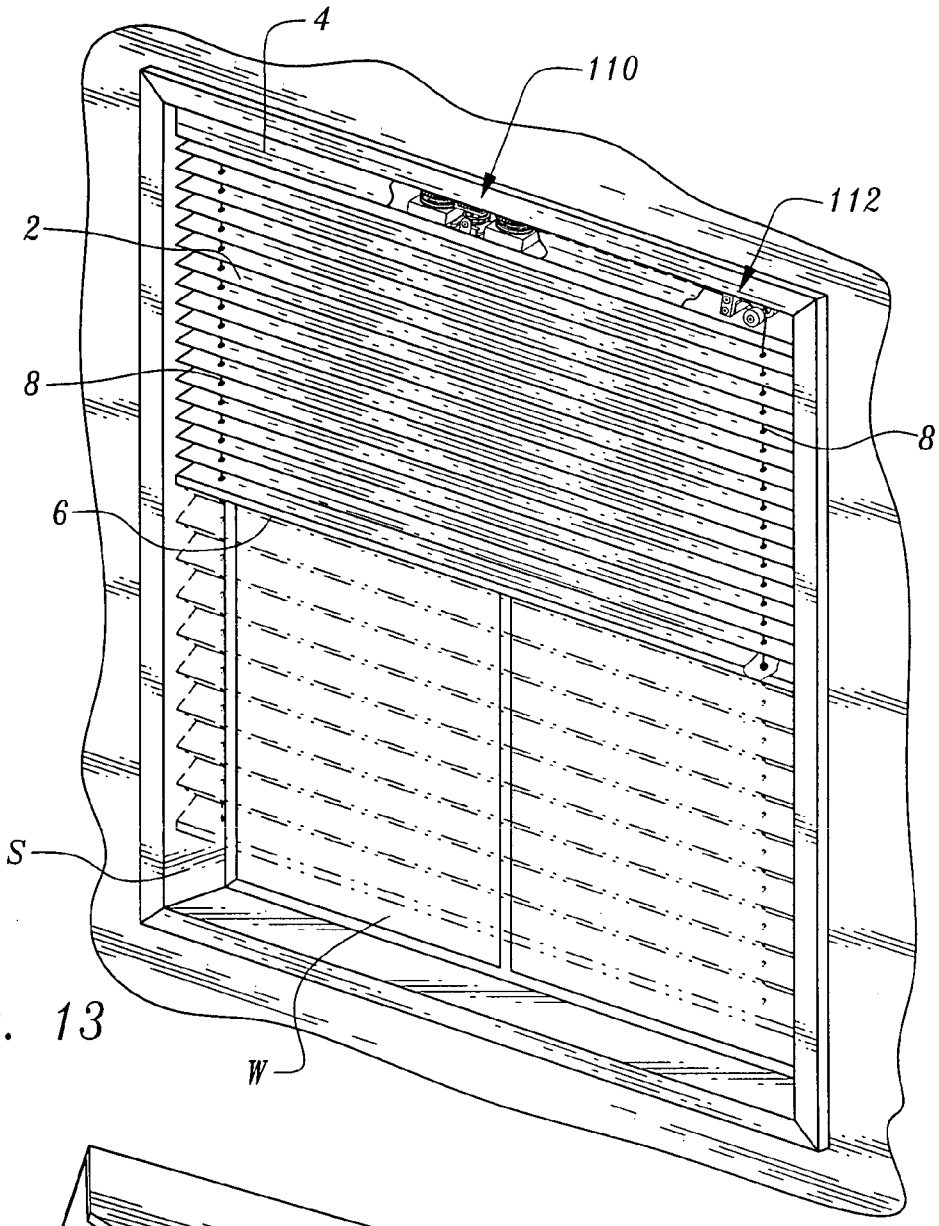
FIG. 13 is a perspective view of a window with an alternative embodiment window covering therein having the lifting mechanism located within the top rail of the window covering, rather than in the bottom rail of the window covering, and with portions of the top rail removed to show the lifting mechanism therein.
Figure 14:
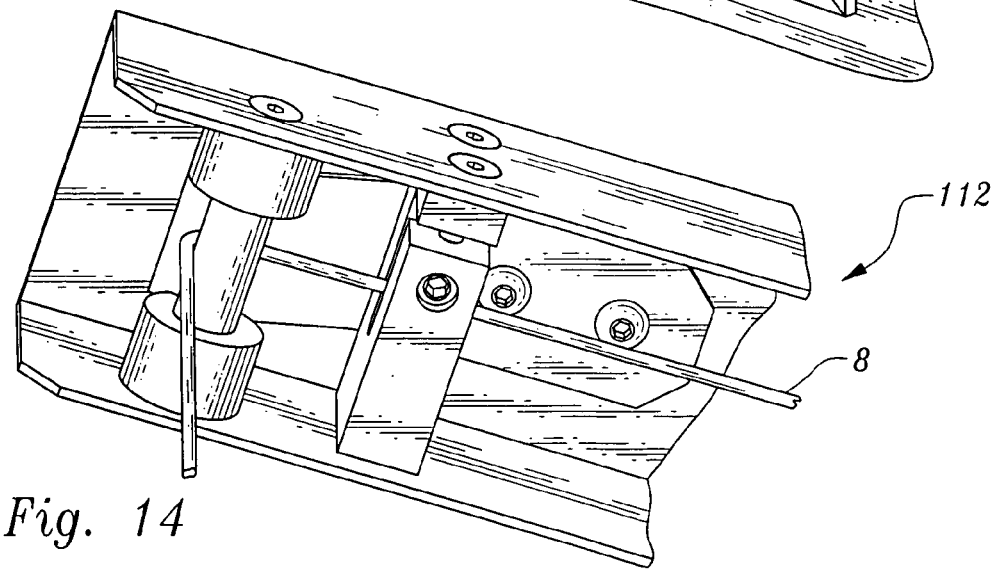
FIG. 14 is a perspective view of an alternative embodiment cord redirector for use with a lifting mechanism located within the top rail of a window covering, such as that shown in FIG. 13.

The top rail 4 is preferably a rigid elongate structure. The top rail 4 is fastened to an upper portion of a casing S surrounding a window W. The top rail 4 suspends the entire window covering assembly from the casing S. The top rail 4 can be fastened to the casing S with adhesive, with mechanical fasteners, or with other fastening methodologies known in the window covering arts. The top rail 4 can optionally include the lifting mechanism 10 therein (FIGS. 13 and 14). Preferably, however, the top rail 4 does not include the lifting mechanism 10 therein. If necessary, the top rail 4 can be reinforced adjacent where the cords 8 are affixed to the top rail 4.

The bottom rail 6 is an elongate substantially rigid structure. The bottom rail 6 is preferably hollow so that the lifting mechanism 10 can be placed therein. The bottom rail 6 preferably includes the lifting mechanism 10 therein, but can optionally be vacant with the lifting mechanism 10 included in the top rail 4 (FIGS. 13 and 14). The bottom rail 6 also acts as a grasping structure to allow a user to grab and reposition the bottom rail 6 where desired.

The window covering 2 extending between the top rail 4 and the bottom rail 6 can be any of a variety of different window coverings known in the art. For instance, the window covering 2 can be in the form of a continuous shade which is either pleated or unpleated, and can form either a single layer between the top rail 4 and the bottom rail 6 or include multiple layers. If multiple layers are included, these layers can be coupled together such that the window covering 2 takes on a cellular form with a "hive-like" cross-section. The window covering 2 could also be in the form of blinds made up of separate slats tethered together that may be fixed or rotatable to vary an amount of light passing therethrough.

At least one cord 8 extends between the top rail 4 and the bottom rail 6. Most preferably, two cords 8 are provided between the top rail 4 and the bottom rail 6. Optionally, more than two cords 8 could be provided. Each of the cords 8 is preferably circular in cross-section and formed of a flexible woven textile material or a flexible plastic material such as nylon or polyethylene. Alternatively, the cords 8 could be in the form of metal chain, plastic chain, fabric chain, flexible tape, flexible ribbon, or any other flexible elongate structure suitable for suspending the bottom rail 6 from the top rail 4 and being handled by the various cord handling mechanisms of this invention. When the term cords is used, it is used generally to refer to any such elongate flexible structures.

The window covering 2, top rail 4, bottom rail 6 and cords 8 together form the window covering assembly which includes the lifting mechanism 10 according to this invention. The entire window covering assembly is preferably configured to be readily adjusted in width to generally match a width of the casing S adjacent the window W. Specifically, the lifting mechanism 10 and the cord redirectors 20 are preferably located sufficiently near to a center of the window covering assembly so that about half of the overall width of the window covering assembly is between the cords 8 and about one-fourth of the window covering assembly is on either side of the cords 8. The window covering 2, top rail 4 and bottom rail 6 can thus be cut, typically with equal amounts being cut from each end of the widow covering 2, top rail 4 and bottom rail 6, to adjust to a width of the casing S up to nearly one-half of the original width of the window covering assembly.

Numerous different window cutting methodologies and cutting tools can be utilized to facilitate such cutting. One such tool and associated methodology is described in U.S. patent application Ser. No. 10/402,452 projected to publish on Sep. 30, 2004. The contents of U.S. patent application Ser. No. 10/402,452 are incorporated herein by reference.

With particular reference to FIGS. 2-5, particular details of a housing 12 for the lifting mechanism 10 and the cord redirector 20 of this invention are described. The bottom rail 6 (FIGS. 1 and 2*c*) is preferably hollow with a generally elongate rectangular geometry. The lifting mechanism 10 is preferably mounted upon a housing 12 which is sized slightly smaller than the hollow interior of the bottom rail 6 so that the housing 12 of the lifting mechanism can fit securely within the bottom rail 6. As an alternative, the housing 12 and bottom rail 6 could be integrated together.

Figures 2, 2A, 2B, 2C:
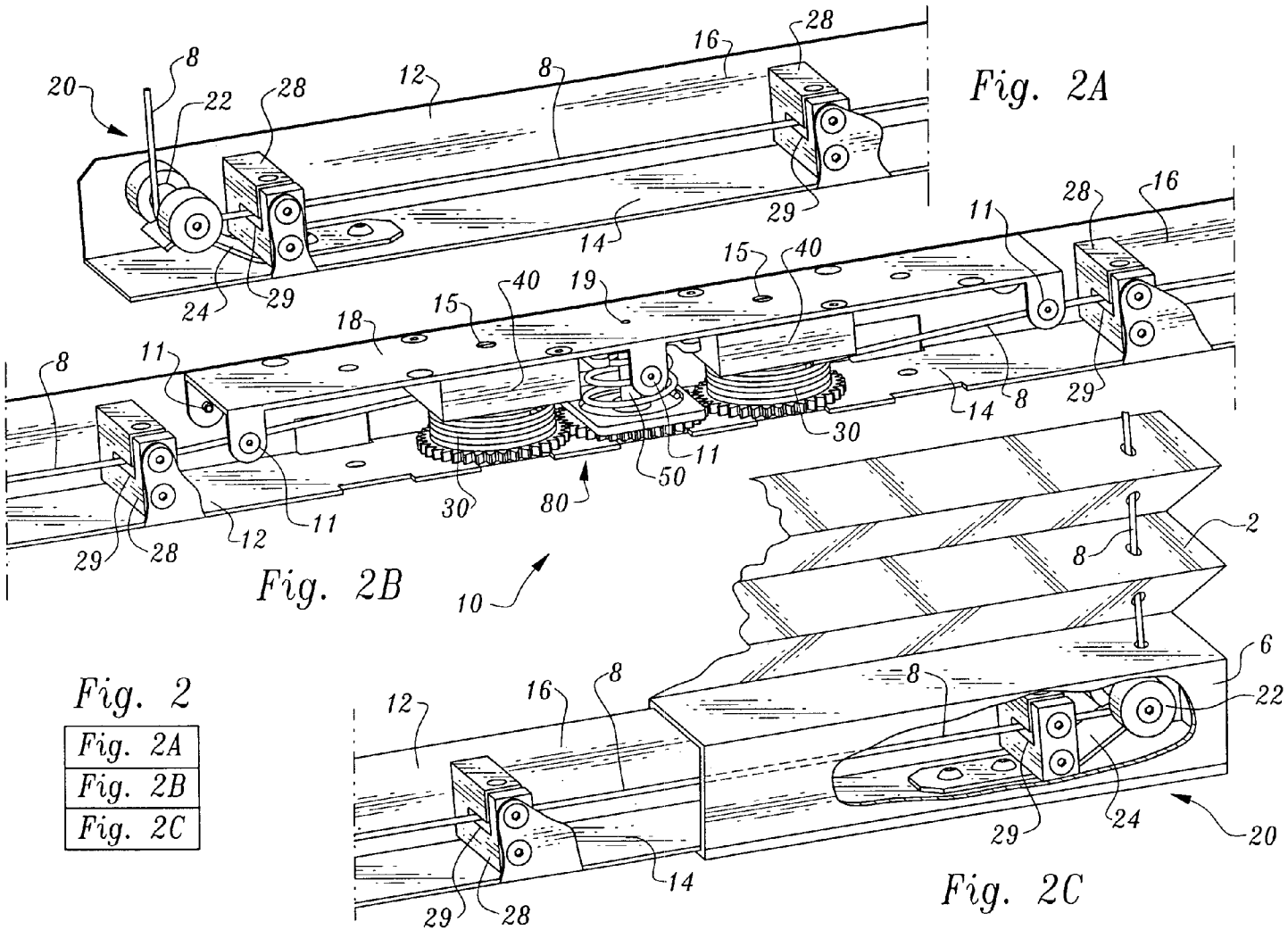
FIG. 2 is a perspective view of portions of the lifting mechanism and cord handling structures located within an interior of the bottom rail and with the figure broken into three parts (2A, 2B and 2C) to fit on a common sheet.
Figure 5:
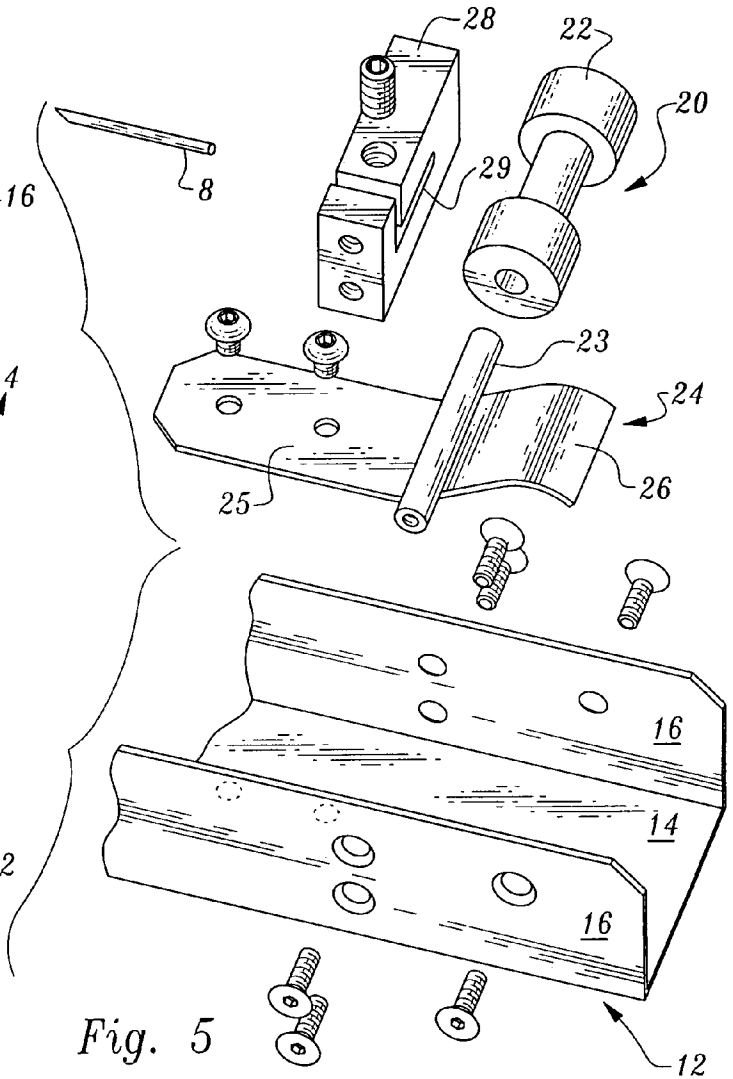
FIG. 5 is an exploded parts view of the cord redirector of FIG. 3.

The housing 12 is an elongate rigid structure which supports the various different components of the lifting mechanism 10 to securely hold these components in precise position relative to each other to maximize desirable function for the lifting mechanism 10. The housing 12 thus includes a generally flat horizontal floor 14 with walls 16 extending perpendicularly up from front and rear sides of the floor 14. A cover 18 is separately provided which spans upper edges of the walls 16 to close the housing 12 (FIG. 2*b*). Cover screws 11 (FIG. 2*b*) are provided to secure the cover 18 to the housing 12.

The housing 12 preferably includes multiple holes through which various different components are supported. These holes include alignment holes 15 for maintaining alignment of the spools 30 and associated structures. The housing 12 also includes gear clearance holes 17 which allow the gears such as the spool gears 82 coupled to the spools 30 and the resistance gear 84 coupled to the progressive resister 50 to have a maximum diameter and to allow the housing 12 to be formed by bending the walls 16 up from the floor 14 without concern for any curvature where the walls 16 and floor 14 are joined together. An alignment hole 19 is further provided to maintain alignment of the progressive resister 50 relative to the housing 12.

Figure 12:
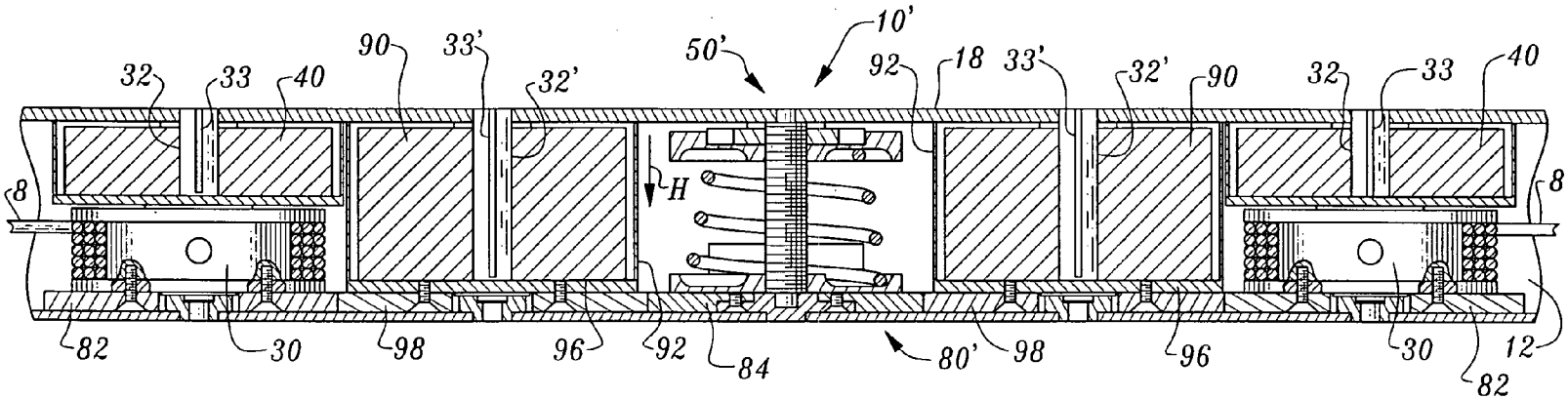
FIG. 12 is a full sectional view of that which is shown in FIG. 11.
Figure 11:
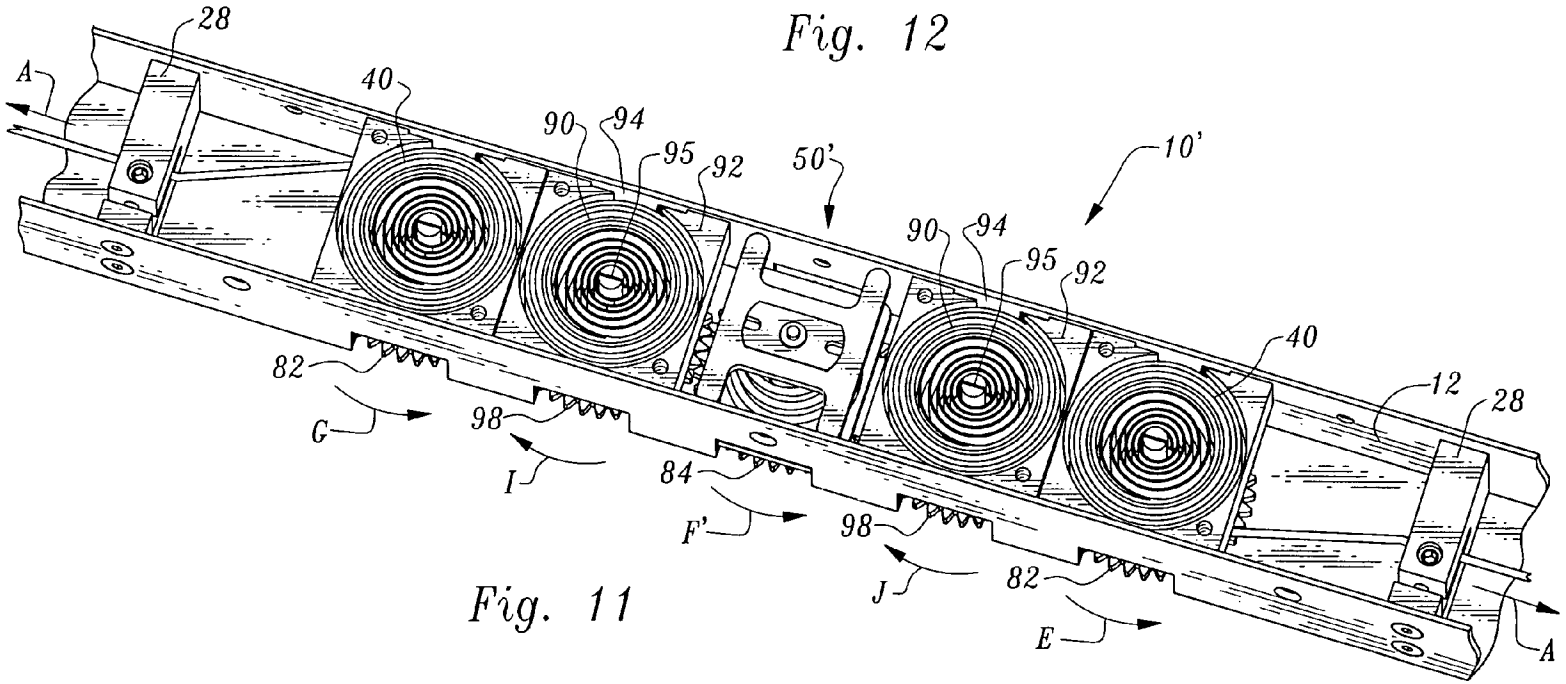
FIG. 11 is a perspective view of an alternative embodiment of the lifting mechanisms of FIG. 6, with the embodiment of FIG. 11 including a pair of auxiliary springs to enhance biasing forces applied to the spools of the lifting mechanism of this alternative embodiment.

Additional holes are provided on the housing 12 such as to facilitate the inclusion of the auxiliary springs 90 and associated equipment for the alternative embodiment of FIGS. 11 and 12. If the housing 12 were to be placed within the top rail 4 rather than the bottom rail 6, the housing 12 would be substantially the same, except that it would be reversed as necessary to allow the cords 8 to extend down from the housing 12, rather than extending up from the housing 12.

The cord redirectors 20 (FIGS. 3-5) are provided to redirect the cords 8 from extending horizontally within the bottom rail 6 (arrows A and B of FIG. 4) to extending substantially vertically up to the top rail 4. The cord redirectors 20 are preferably identical in form and rotatably supported by the housing 12.

As particularly shown in FIGS. 2-5, each cord redirector 20 includes a pulley 22 rotatably (arrow C of FIG. 4) supported by an axle 23 which is coupled to the opposite walls 16 of the housing 12. The pulley 22 preferably is narrower near a center thereof and wider at edges thereof adjacent the walls 16. This contouring of the pulley 22 helps to keep the cord 8 passing around the pulley 22 near a center of the pulley 22.

Preferably, a cord tensioner 24 is located adjacent the pulley 22. Specifically, the tensioner 24 is in the form of a resilient structure such as a piece of spring steel which includes a base 25 fastened to the floor 14 of the housing 12. A finger 26 extends up from the base 25 resiliently and presses the cord 8 against the pulley 22 (along arrow D of FIG. 4). The cord tensioner 24 acts to maintain tension between the pulley 22 and the spools 30 of the lifting mechanism 10. The tensioners 24 thus assist in keeping the cord 8 from binding or otherwise getting out of position within an interior of the bottom rail 6. The tensioner 24 also beneficially adds a small amount of constant resistance to the passage of the cord 8 over the pulley 22, which generally acts to dampen the overall function of the lifting mechanism 10 and decrease any bouncing or recoil affects which might be caused by the springs 40.

Preferably, a cord guide 28 is located adjacent each of the cord redirectors 20. The cord guides 28 include a groove 29 therein which can capture the cord 8 therein but freely allow the cord 8 to pass linearly therethrough. The cord guides 28 can be provided at various different positions along the housing 12 and between the lifting mechanism 10 and the cord redirectors 20. The cord guides 28 generally help to keep the cord 8 in a desired position and decrease the opportunity for the cords 8 to become entangled, knotted, or otherwise out of position.

Figure 7:
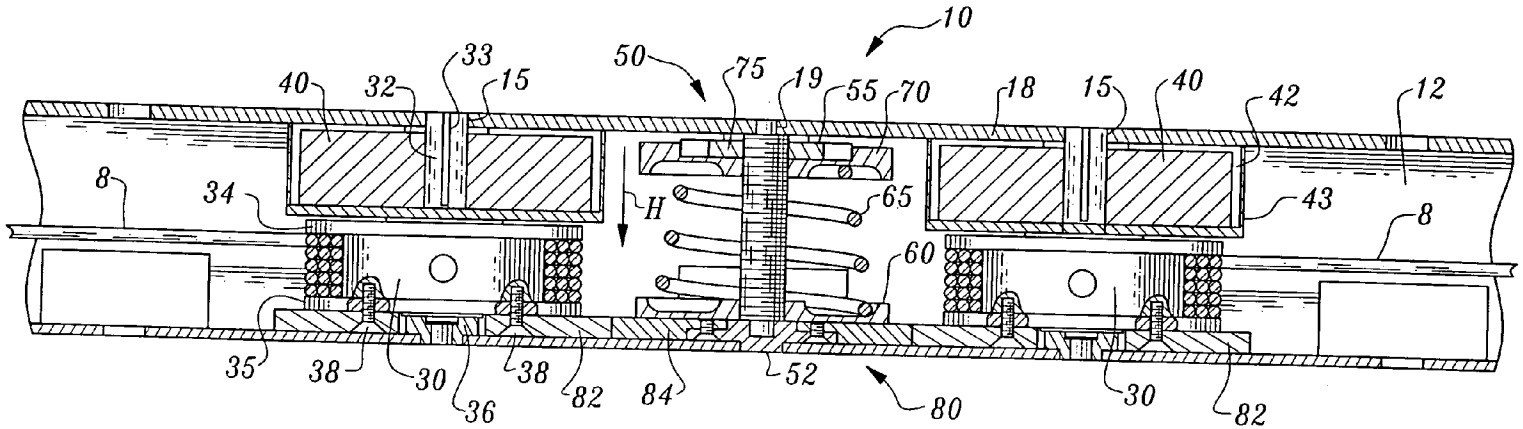
FIG. 7 is a full sectional view of that which is shown in FIG. 6 and including the cover.
Figure 8:
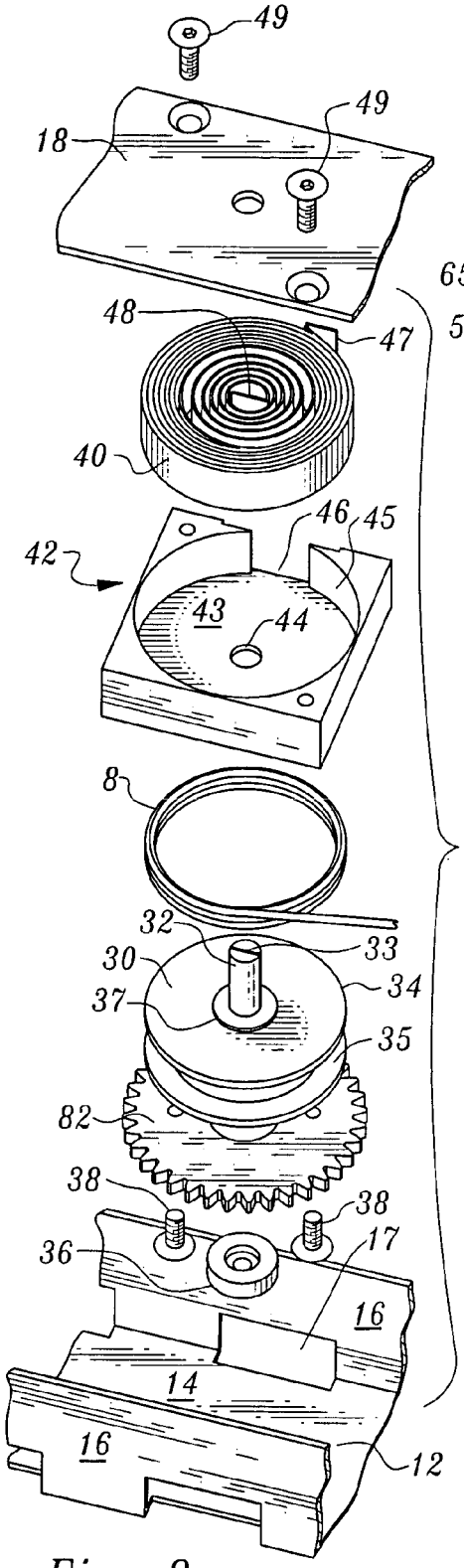
FIG. 8 is an exploded parts view of one of two spool and spring assemblies making up a portion of the lifting mechanism of this invention.
Figure 9:
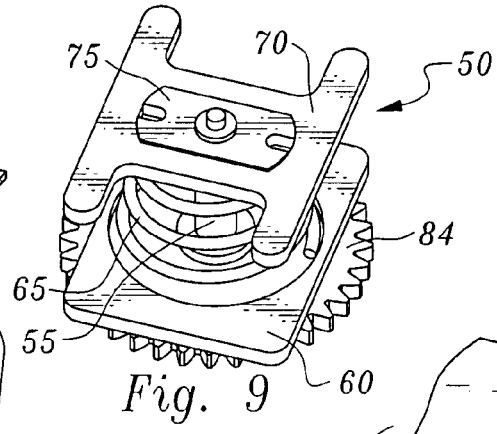
FIG. 9 is a perspective view of a progressive resister of the lifting mechanism of this invention.
Figure 10:
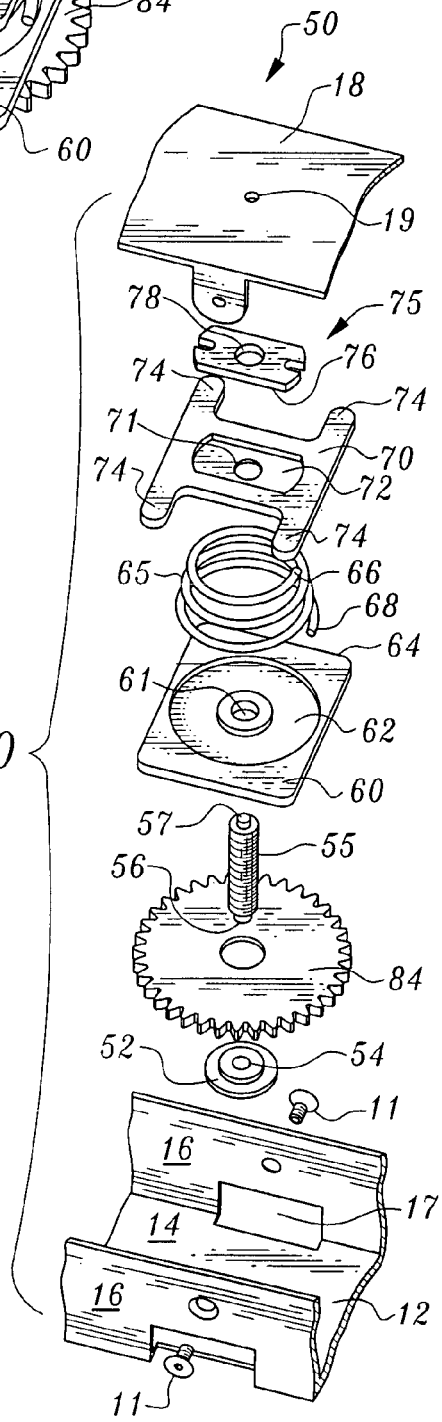
FIG. 10 is an exploded parts view of the progressive resister of FIG. 9.

With particular reference to FIGS. 6-8, details of the spools 30 and springs 40 of the preferred embodiment of the lifting mechanism 10 of this invention are described. The spools 30 and springs 40 provide primary components of the lifting mechanism 10 which causes the cord 8 to be gathered up or played out from the lifting mechanism 10 and correspondingly allow the bottom rail 6 to be lifted (arrow B of FIG. 1) or lowered (arrow A of FIG. 1). The spools 30 provide a preferred form of cord collector for gathering up the cord 8 when the bottom rail 6 is raised and for playing out the cords 8 when the bottom rail 6 is lowered.

Most preferably, two spools 30 or other cord collectors are provided with each of these spools 30 coupled to a separate one of the two cords 8 of the preferred embodiment. It is conceivable that a single spool 30 could be coupled to a single cord 8 or that a single spool 30 could simultaneously gather two or more cords 8 and still function according to this invention. Also, more than two spools 30 could be provided and more than two cords 8.

Other forms of cord collectors which can function as a means to collect cords within the lifting mechanism 10 of this invention could include cord gathering cavities into which the cord 8 could be fed and released without winding of the cord, or multiple axle cord collection spindles, or other components capable of gathering up the cord 8 and containing the cord 8 in a defined region until the cord 8 is to be released.

According to the preferred embodiment, each of the spools 30 includes a central post 32 rigidly coupled thereto. The post 32 includes a slit 33 therein for connection to an associated spring 40 or other biaser, discussed in detail below. The spools 30 include an upper wall 34 spaced from a lower wall 35, with each of the walls 34, 35 defining portions of the spools 30 which extend radially away from the post 32 and a rotational central axis of the spools 30, a greater amount than other portions of the spools 30. A space between the walls 34, 35 defines a cord collection region for the spool 30. The walls 34, 35 keep the cord 8 from working its way off of the spools 30 and becoming entangled within other portions of the lifting mechanism 10.

A lower bearing 36 is provided with a generally doughnut shape and which supports a lower end of the post 32 in a rotating fashion. The lower bearing 36 preferably remains stationary, but could optionally rotate, and rests within a hole in the floor 14 of the housing 12 (FIGS. 2 and 7). The lower bearing 36 provides rotational support for the spool 30 and keeps the post 32 of the spool 30 from translating while allowing the post 32 and spool 30 to freely rotate. The lower bearing 36 also keeps a spool gear 82 spaced above the floor 14 of the housing 12.

An upper bearing 37 adjacent the upper wall 34 separates rotating portions of the spool 30, including the upper wall 34 from portions of the spring 40 adjacent thereto, so that friction contact and associated resistance is minimized between the spool 30 and the adjacent spring 40. Gear screws 38 attach the spool gear 82 (described in detail below) to the lower wall 35 of the spool 30. Thus, the spool 30 and associated post 32 are caused to rotate along with the spool gear 82.

The springs 40 provide a preferred form of biaser for the spools 30 or other cord collectors. Preferably, one spring 40 is provided for each spool 30. However, multiple springs 40 can be provided for each spool 30, or a single spring 40 could be provided for multiple spools 30. The springs 40 act as a preferred form as a means to bias the spools 30 or other cord collection means toward collecting more of the cord 8 upon the spool 30. Thus, the springs 40 tend to cause the cord 8 to be wound up onto the spools 30.

Countervailing forces including the weight of the bottom rail 6 and associated components located within the bottom rail 6, as well as friction induced into the system, counteract this biasing force of the spring 40. The bottom rail 6 of the window covering assembly thus remains stationary in a position where it is placed by a user, unless a user adds a lifting force upward (along arrow B of FIG. 1) or downward (along arrow A of FIG. 1) to counteract the equilibrium between the forces applied by the springs 40 upon the spools 30 and weight forces and friction forces applied to the spools 30.

While the springs 40 provide a preferred form of biaser, other forms of biasers could similarly be utilized to provide a means to bias the spool 30 or other cord collector toward collecting more of the cord 8. For instance, the biaser could be in the form of a resilient structure such as a rubber band. The biaser could also be in the form of various different configurations of springs, rather than merely the helical spring 40 of the preferred embodiment.

The spring 40 of the preferred embodiment resides within a cavity 42 which acts as a housing for the spring 40 to keep the workings of the spring 40 from being obstructed. The cavity 42 includes a generally flat floor 43 with a post hole 44 therein which allows the post 32 to extend up through the cavity 42. The cavity 42 additionally includes sides 45 which are generally cylindrical in form facing the cavity 42.

A gap 46 is formed in one of the sides 45. This gap 46 helps to anchor one end of the spring 40 in a stationary fashion while an opposite end of the spring 40 is coupled to the post 32. Specifically, the spring 40 is preferably in the form of a helical spring having an outer tab 47 at an outermost end of the spring 40 and an inner tab 48 at an innermost end of the spring 40. The outer tab 47 is configured to pass through the gap 46 and be secured to the cavity 42 structure.

Because the cavity 42 is generally square in form, it is not capable of rotating within the housing 12 (FIG. 2). Additionally, cavity screws 49 are preferably utilized to secure the cavity 42 to the cover 18 to further prevent the cavity 42 and the outer tab 47 connected thereto from moving.

The inner tab 48 is oriented within the slit 33 in the post 32. Hence, when the spool 30 rotates and the post 32 rotates along with the spool 30, the inner tab 48 of the spring 40 is also caused to rotate. Such rotation of the inner tab 48 causes the spring 40 to be wound up or wound down, depending on the direction of rotation of the spool 30. In this way, the spring 40 acts according to the preferred embodiment to bias the spool 30 or other cord collector toward collecting greater and greater amounts of the cord 8 upon the spool 30 or other cord collector.

With particular reference to FIGS. 6, 7, 9 and 10, particular details of the progressive resister 50 of the preferred embodiment are described. The progressive resister 50 provides a preferred form of a means to resist motion of the spool 30 or other cord collector. The progressive resister 50 thus introduces a friction force which acts with gravity forces to oppose the biasing forces associated with the spring 40 or other biaser, so that equilibrium can be provided for the spool 30 or other cord collector and a position of the bottom rail 6 can be maintained unless external forces, such as those provided by a hand of a user, are applied to the bottom rail 6.

The progressive resister 50 of the preferred embodiment preferably is provided as a single unit which acts upon a pair of spools 30 with each of the spools 30 acting upon a separate one of two cords 8 within the window covering assembly. Alternatively, a single progressive resister 50 could act upon a single spool 30 or other cord collector in a single cord version of the window covering assembly. Similarly, multiple progressive resisters 50 could be provided acting upon a single spool 30 or upon multiple spools 30. In embodiments where multiple progressive resisters 50 are utilized, each spool 30 can have its own progressive resister 50. The multiple spools 30 can either be linked together by gears or otherwise, or the spools 30 can be independent of each other.

The progressive resister 50 according to the preferred embodiment includes a base bearing 52 which supports other portions of the progressive resister 50 above the floor 14 of the housing 12. The base bearing 52 preferably extends at least partially into a hole in the floor 14 of the housing 12 (FIG. 7) so that the base bearing 52 and other portions of the progressive resister 50 are prevented from translating, but rather are restricted only to rotation. Bearing screws 53 preferably secure the base bearings 52 to a resistance gear 84 forming part of the gear set 80 described in detail below. This preferred arrangement (FIG. 7) causes the base bearing 52 to rotate along with the resistance gear 84. Alternatively, the bearing screws 53 can be omitted and the resistance gear 84 can rotate relative to the base bearing 52.

The base bearing 52 includes a bore 54 in an upper end thereof. The bore 54 is aligned with a central axis of the base bearing 52 and supports a threaded shaft 55 of the progressive resister 50 extending vertically up from the bore 54 of the base bearing 52. Particularly, the threaded shaft 55 preferably includes a lower tip 56 which extends down into the bore 54. An upper tip 57 of the threaded shaft 55 extends into the alignment hole 19 and the cover 18 of the housing 12 (FIGS. 2 and 7) so that the threaded shaft 55 of the progressive resister 50 is prevented from translating, but rather is only allowed to rotate about a vertical central axis of the threaded shaft 55.

The lower tip 56 of the threaded shaft 55 can be keyed and have a contour matching that of the bore 54 so that the threaded shaft 55 rotates with the base bearing 52. Alternatively, or in addition a fastener can be utilized to secure the lower tip 56 of the threaded shaft 55 within the base 24. When the base bearing 52 is fastened to the resistance gear 84 with the bearing screw 53 (FIG. 7) and the lower tip 56 of the threaded shaft 55 is secured into the bore 54, rotation of the resistance gear 84 causes corresponding rotation of the base bearing 52 and the threaded shaft 55.

Alternatively, the lower tip 56 of the threaded shaft 55 can rotate relative to the bore 54. In such an embodiment (FIG.

10) a lower portion of the threaded shaft 55 would be affixed to the resistance gear 84 directly, so that the threaded shaft 55 always rotates along with the resistance gear 84.

A bottom plate 60 of the progressive resister 50 is oriented directly adjacent the resistance gear 84. The bottom plate 60 provides a preferred form of brake with a lower surface of the bottom plate 60 abutting the resistance gear 84 and with this abutment imparting a resistance force against free rotation of the resistance gear 84, which is proportional to a force with which the bottom plate 60 is pressed against the resistance gear 84. The bottom plate 60 has a generally square form so that it is prevented by the walls 16 of the housing 12 from rotating. Hence, the bottom plate 60 does not rotate along with the resistance gear 84 and the threaded shaft 55.

The bottom plate 60 includes a center hole 61 through which the threaded shaft 55 is allowed to pass without contact or obstruction. A recess 62 is preferably formed in an upper surface of the bottom plate 60. The recess 62 facilitates support of a compression spring 65 adjacent the upper surface of the bottom plate 60. A perimeter 64 of the recess 62 is generally cylindrical and has a diameter similar to a lower portion of the compression spring 65. Thus, the compression spring 65 is held within the recess 62 and is prevented from translating laterally relative to the bottom plate 60 and other portions of the progressive resister 50.

The compression spring 65 includes an upper end spaced from a lower end 68. The lower end 68 abuts the bottom plate 60 within the recess 62. The upper end 66 abuts a top plate 70 of the progressive resister 50.

The compression spring 65 is preferably generally helical in form and particularly configured so that a spring force of the compression spring 65 increases as the compression spring 65 is compressed between the upper end 66 and the lower end 68, such as by moving the top plate 70 toward the bottom plate 60.

To maximize a degree of travel between the upper end 66 and the lower end 68, the compression spring 65 can be slightly conically tapered with the upper end 66 having a slightly smaller diameter than the lower end 68. In this way, the compression spring 65 can be collapsed with turns in the compression spring 65 being progressively inboard of each other and maximizing a degree of collapse which can be experienced by the compression spring 65. Alternatively, the compression spring 65 could be replaced with other forms of springs or resilient structures which would be capable of exerting a force down upon the bottom plate 60 when the top plate 70 is lowered against upper portions of the force applying structure, such as the compression spring 65.

The top plate 70 is generally planar with a lower surface of the top plate 70 adapted to abut the upper end 66 of the compression spring 65. A center hole 71 passes through the top plate 70, allowing the threaded shaft 55 to pass therethrough. The top plate 70 preferably includes a depression 72 therein which is shaped to support a threaded key 75 within the top plate 70. Alternatively, a threaded key 75 can be integrally formed with other portions of the top plate 70. The depression 72 is sized to allow the threaded key 75 to fit snugly therein so that the threaded key 75 and top plate 70 act together as a single unit. By making the threaded key 75 from a separate structure from other portions of the top plate 70, the threaded key 75 can be formed of a harder material than the top plate 70 to maximize performance of the top plate 70 and coaction with the threaded shaft 55.

The top plate 70 includes arms 74 which extend away from the center hole 71 and are adapted to abut the walls 16 of the housing 12. The top plate 70 is thus held by the arms 74 so that the top plate 70 cannot rotate. Rather, the top plate 70 can only translate vertically along a central axis of the threaded shaft 55.

The threaded key 75 includes a perimeter contour 76 matching that of the depression 72 so that the threaded key 75 fits securely within the depression 72. A threaded hole 78 passes through the threaded key 75. The threaded hole 78 includes threads therein which match a pitch of the threaded shaft 50.

To maximize a range of travel of the top plate 70, the threaded shaft 55 and threaded key 75 preferably have a very shallow pitch to their corresponding threads. When the resistance gear 84 rotates, the threaded shaft 55 rotates along with the resistance gear 84. The threaded key 75 translates vertically (along arrow H of FIG. 7) along the threaded shaft 55 with the top plate 70 when the threaded shaft 55 is rotating.

When such rotation is in a direction causing the top plate 70 to move toward the bottom plate 60, the compression spring 65 is compressed a greater and greater amount. As the compression spring 65 is compressed, it exerts a progressively greater force vertically down upon the bottom plate 60. The bottom plate 60 is thus urged with greater and greater force against the resistance gear 84. This in turn makes it progressively more difficult for the resistance gear 84 to rotate along with the spool gear 82 coupled to the spool 30.

With particular reference to FIGS. 6 and 7, details of the gear set 80 of the lifting mechanism 10 of this invention are described. The gear set 80 provides a preferred means for coupling the spools 30 or other cord collectors to the progressive resister 50 or other means to resist rotation of the cord collectors. Particularly, in the preferred embodiment a single resistance gear 84 is located between two spool gears 82 with each of the spool gears 82 associated with a separate spool 30. The gears 82, 84 are all meshed together so that rotation of the spool gears 82 requires rotation of the resistance gear 84. When resistance to resistance gear 84 rotation is induced by the progressive resister 50, rotation of the spool gears 82 is similarly resisted. Thus, resistance to spool 30 rotation and associated cord collection is provided by the progressive resister 50.

As an alternative, the gear set 80 could include idler gears between the adjacent gears 82, 84, or additional gears could be provided with additional function associated with such additional gears.

In the preferred embodiment, the spool gears 82 preferably rotate in a common direction (about arrows G and E of FIG. 6), with the resistance gear 84 rotating in an opposite direction (about arrow F of FIG. 6). Arrows E, F, G of FIG. 6 correspond with the cord 8 being played off of the spools 30, as would be the case when the bottom rail 6 is being lowered (along arrow A of FIG. 1). When the bottom rail 6 is being raised, each of these arrows would be reversed to indicate reverse direction for the gears 82, 84.

While the gear set 80 provides the preferred form of coupling the progressive resister 50 to the spools 30, other forms of coupling could be provided. For instance, the progressive resister 50 could act directly upon the spools 30. For instance, in place of the springs 40, a progressive resister 50 could press directly against the upper wall 34 of the spool 30 through the bottom plate 60 so that resistance to spool 30 rotation would result. In such an arrangement, the springs 40 or other biasers would likely need to be geared to the spools 30 so that appropriate biasing forces tending to collect cord 8 upon the spool 30 would be provided.

The gear set 80 advantageously links the spools 30 together so that in window coverings with two or more cords 8, the cords 8 are gathered in equal amounts onto the spools 30 and the bottom rail 6 remains horizontal and parallel to the top rail 4. Such linking is not required however. Also, linking of the spools 30 as well as other components could be provided with alternative means to link the components together. For instance, belts, chains, sprockets, shafts and other mechanical couplings could be utilized to link the components together.

If sufficient height were available within the rails 4, 6 housing the lifting mechanism 10, it is conceivable that both the spools 30, springs 40 and progressive resisters 50 could all be stacked together vertically. If a particularly low profile rail 4, 6 is desired, the spools 30, springs 40 and progressive resisters 50 could all be laterally spaced from each other and geared together to an appropriately modified gear set 80. If the progressive resister is to be shortened to less than an overall height of the rails 4, 6 in which the lifting mechanism 10 is located, multiple progressive resisters 50 could be provided and configured so that progressively greater and greater resistance would be provided through multiple separate progressive resisters 50 having a shorter overall profile.

With particular reference to FIGS. 11 and 12, an alternative embodiment of the lifting mechanism 10 is disclosed, referred to by reference numeral 10'. The lifting mechanism 10' is similar to the lifting mechanism 10 of the preferred embodiment (FIGS. 6 and 7) except where specifically described herein. In this embodiment of FIGS. 11 and 12, a pair of auxiliary springs 90 are provided adjacent the progressive resister 50, and the combination of spools 30 and springs 40 of the preferred embodiment are placed further outboard away from the progressive resister 50.

Each auxiliary spring 90 includes a housing 92 generally similar to the cavity 42 for the springs 40 of the preferred embodiment. Each auxiliary spring 90 includes an outer end 94 spaced from an inner end 95 which can coact with posts 32' including slits 33' coupled to auxiliary spring gears 98. The housings 92 generally define deep cavities 96 in which the auxiliary springs 90 are located.

In this embodiment the auxiliary springs 90 have generally twice the height of the springs 40 of the preferred embodiment. Hence, significantly greater biasing forces can be provided when the auxiliary springs 90 are added to the lifting mechanism 10'. Auxiliary spring bearings 99 allow the auxiliary spring gears 98 to float slightly above the floor of the housing 12 to allow the auxiliary spring gears 98 to freely rotate. The spool gears 82 rotate in a similar direction to that of the preferred embodiment. however, the auxiliary gears 98 rotate in an opposite direction (along arrows I and J of FIG. 11), so that the resistance gear 84 rotates the same direction as the spool gears 82 (along arrow F of FIG. 11).

The auxiliary springs 90 provides significantly greater force tending to cause the spools 30 to collect the cords 80 thereon. Such an arrangement is desirable in situations such as where the window covering 2 is formed of an exceptionally heavy material so that additional lifting force and cord collection force is required to balance the weight of the window covering 2. Similarly, if a heavy bottom rail 6 is provided, or if the entire window covering assembly is configured for use in an exceptionally tall window W (FIG. 1), such auxiliary springs 90 may be necessary or desirable to allow the lifting mechanism 10 to properly balance the window covering assembly.

With particular reference to FIGS. 13 and 14, another alternative embodiment for the window covering assembly is described. In this embodiment a top rail lifting mechanism 110 is provided. The top rail lifting mechanism 110 is located within the top rail 4 rather than in the bottom rail 6. A top rail cord redirector 112 is depicted in FIGS. 13 and 14. The top rail cord redirector 112 is similar to the cord redirector 20 of the preferred embodiment except that it redirects the cord 8 from extending in a horizontal direction within the top rail 110 to extending vertically downward to the bottom rail 6.

Placing the lifting mechanism 110 within the top rail 4 allows the bottom rail 6 to have a smaller configuration. Preferably, when the bottom rail 6 has a lower profile, the bottom rail 6 is provided with sufficient weight so that gravity forces tending to pull the cords 8 out of the cord collector are sufficient to overcome the biasing forces such as those provided by the springs 40, to keep the lifting mechanism 10 in appropriate equilibrium. In addition to adding weights to the bottom rail 6, or as an alternative thereto, the springs 40 or other biasers can be provided with a lighter force. Additionally, resistance added to the system through the tensioners 24 (FIGS. 3-5) and through the progressive resister 50 would need to be appropriately modified to assure proper function of the lifting mechanism 110 located within the top rail 4.

With particular reference to FIG. 1, the use and operation of the lifting mechanism 10 for the window covering assembly of this invention is described. Initially, presume that the bottom rail 6 of the window covering assembly is in an intermediate position as shown in solid lines in FIG. 1. If the user desires to lower the bottom rail 6 so that a greater portion of the window W is covered by the window covering assembly, the user grasps the bottom rail 6 and applies a downward force on the bottom rail 6.

Before applying this downward force, the bottom rail 6 is in equilibrium. Particularly, the lifting mechanism 10 has a portion of the cord 8 wound upon the spools 30. The springs 40 are applying a force on the spools 30 tending to gather additional cord 8 onto the spools 30. A weight of the bottom rail 6 is acting through the pulleys 22 at the cord redirector 20, tending to cause the bottom rail 6 to move downward and causing the cords 8 to be played off of the spools 30.

These gravitational forces and spring 40 or other biasing forces are in equilibrium so that the spools 30 are at rest and the bottom rail 6 is at rest. Additionally, the progressive resister 50 as well as the tensioner 24 are adding additional resistance to cord 8 movement in either direction and spool 30 rotation in either direction to assist in maintaining equilibrium and stationary positioning of the spool 30.

When the user applies a downward force upon the bottom rail 6, this equilibrium is disturbed. Specifically, now both the gravitational forces acting downward on the bottom rail 6 and the forces applied by the user work together to overcome the biasing forces acting upon the spools 30 through the springs 40 and to overcome resistance forces applied by the tensioner 24 and the progressive resister 50. The bottom rail 60 moves down and cord 8 is played off of each of the spools 30.

As the bottom rail 6 moves downward (along arrow A of FIG. 1) the user then releases the bottom rail 6 when the bottom rail 6 is at a position where desired. When the user releases the bottom rail 6, only the gravitational weight forces acting on the bottom rail 6 remain to counteract the spring forces 40 acting upon the spools 30.

So that a new equilibrium condition can be achieved by the lifting mechanism 10, the progressive resister 50 is provided which is progressive in nature. Particularly, with the bottom rail 6 in a lower position, and with more of the cord 8 played off of the spool 30, the springs 40 are applying a greater biasing force upon the spools 30. Also, to some extent a weight of the window covering 2 is partly suspended from the top rail 4 directly, rather than suspended through the bottom rail 6 and the cords 8.

Without the progressive resister 50, the bottom rail 6 would tend to bounce upward and not remain in a fully closed position covering the window W. However, with the progressive resistance 50 provided by the progressive resister 50, the progressive resister 50 is applying a progressively greater amount of resistance to spool 30 rotation as the cord 8 is played off of the spools 30. This resistance applied by the progressive resister 50 is thus sufficient to counteract the biasing forces applied by the springs 40 or other biasers upon the spools 30. Equilibrium is then maintained when the bottom rail 6 is at the lower position.

When the user wishes to raise the bottom rail 6, the user grasps the bottom rail 6 and lifts upward on the bottom rail 6. The user is now applying forces which counter gravity forces acting on the system and working with the forces applied by the springs 40 upon the spools 30. These forces together are sufficient to overcome the forces remaining, including gravity forces acting upon the bottom rail 6 and the resistance forces applied by the progressive resister 50. Hence, as the user lifts the bottom rail 6, the cord 8 is gathered upon the spools 30. When the user releases the bottom rail 6, at any position, after movement upward along arrow B of FIG. 1, the bottom rail 6 will again be in equilibrium and remain stationary.

While a user's hand is typically considered to be the control force which causes adjustment of the bottom rail 6 of the window covering assembly, other control forces could cause adjustment of the position of the bottom rail 6. For instance, an automatic window covering assembly could be provided where the bottom rail 6 would be raised or lowered by moving along a track, or by the action of separate cords coupled to a control mechanism such as a servo motor and a separate spool to position the bottom rail 6 where desired, such as through use of a remote control assembly. In such a configuration, the lifting mechanism 10 would sufficiently balance the window covering assembly so that a control mechanism could most easily manipulate the position of the bottom rail 6.

The progressive resister preferably provides progressively greater resistance along an entire range of motion of the cords 8 onto the spools 30 and off of the spools 30. The resistance force provided by the progressive resister 50 is preferably generally a linear function of the amount of cord upon the spool 30 and a generally linear function of the position of bottom rail 6 between the top rail 4 and a lowermost position spaced from the top rail 4. As an alternative, the progressive resister 50 could be configured so that it applies no resistance except when needed. For instance, the progressive resister 50 could be configured so that it provides no resistance until the bottom rail 6 is at a middle position, and then provides progressively greater resistance only for a lower half of bottom rail 6 travel. Similarly, the progressive resister 50 could provide progressively greater resistance in a non-linear fashion, such as proportional to a square of the amount of cord upon the spools 30 or other cord collectors. Some other function than a linear function could similarly be provided, with the goal being to allow the bottom rail 6 to remain in equilibrium and stationary at all positions for the bottom rail 6, between a lowermost position most distant from the top rail 4 and an uppermost position closest to the top rail 4. If a window covering 2 having a non-uniform weight distribution is provided, the progressive resister 50 can be appropriately configured to provide resistance when desired to maintain smooth operation of the lifting mechanism 10 for all different positions for the bottom rail 6.

The progressive resister 50 provides a degree of resistance to rotation of the spool 30 which is similar in both directions for the spool 30. Hence, whether the spool 30 is to rotate to gather additional cord 8 thereon or is to rotate to play additional cord 8 off of the spool 30, a similar amount of resistance is provided. The amount of resistance is correlated with the amount of cord 8 which is on the spool 30, which itself correlates with the position of the bottom rail 6 relative to the top rail 4. The progressive resister 50 thus provides resistance in a similar amount in both a lifting direction (along arrow B of FIG. 1) and in a lowering direction (along arrow A of FIG. 1).

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A window covering assembly capable of maintaining a selected position without requiring manipulation of cords, buttons or other locking mechanisms, the window covering assembly comprising in combination:

a window covering;

a top rail at an upper end of said window covering, said top rail adapted to be attached to a casing adjacent a window;

a bottom rail at a lower end of said window covering;

a cord;

a cord collector, said cord collector coupled to one of said rails;

said cord extending between said cord collector and one of said rails spaced from said cord collector;

a biaser coupled to said cord collector, said biaser adapted to bias said cord collector toward having more cord collected with said cord collector;

a progressive resister coupled to said cord collector;

said progressive resister adapted to provide greater resistance to motion of said bottom rail and cord collection by said cord collector when said bottom rail is in a first lower position than when said bottom rail is in a second higher position above said first lower position; and said cord collector adapted to rotate, said progressive resister including a threaded shaft coupled to said cord collector and adapted to rotate with said cord collector, said progressive resister including a key with a threaded hole adapted to ride along said threaded shaft, said key adapted to add resistance to cord collector rotation when said cord collector rotates to a position with less cord collected thereon.

2. The assembly of claim 1 wherein said assembly includes at least two cords and at least two cord collectors, each of said cords coupled to a separate one of said at least two cord collectors, said progressive resister coupled to at least one of said at least two cord collectors.

3. The assembly of claim 2 wherein said assembly includes at least two progressive resisters, at least two of said cord collectors having at least one progressive resister coupled thereto.

4. The assembly of claim 2 wherein said at least two cord collectors are coupled together such that they collect and release said at least two cords in similar amounts, such that said bottom rail remains parallel with said top rail.

5. The assembly of claim 4 wherein each of said at least two cord collectors include spools adapted to rotate and collect said cords thereon, each of said at least two cord collectors geared together such that said at least two cord collectors always rotate similar amounts.

6. The assembly of claim 5 wherein said progressive resister is geared to each of said at least two cord collectors.

7. The assembly of claim 6 wherein said assembly includes at least two biasers with each of said at least two biasers coupled to one of said at least two cord collectors.

8. The assembly of claim 7 wherein each of said at least two biasers includes a helical spring having a first fixed end and a second end coupled to at least one of said spools, such that rotation of said spools causes deformation of said helical springs and causes said springs to bias said spools toward collection of said cords thereon.

9. The assembly of claim 8 wherein each said helical spring is coupled to a common post with one of said spools, with said common post located concentrically through said spring and said spool.

10. The assembly of claim 9 wherein at least one auxiliary spring is coupled to at lest one of said spools through an auxiliary spring gear geared to said spools and said progressive resister, said at least one auxiliary spring having a fixed end which remains stationary and a second end coupled to an auxiliary spring shaft coupled to said auxiliary spring gear and rotating with said auxiliary spring gear, said auxiliary spring adding additional forces to said spools tending to collect said cords upon said spools.

11. The assembly of claim 1 wherein said window covering includes a shade.

12. The assembly of claim 11 wherein said shade is a pleated single layer of material.

13. The assembly of claim 11 wherein said shade is in the form of pleated cellular material.

14. The assembly of claim 11 wherein said shade includes at least one continuous layer of at least partially opaque material extending between said top rail and said bottom rail.

15. The assembly of claim 1 wherein said window covering includes a blind having a plurality of separate parallel slats joined together by at least one tether, said tether adapted to maintain a spacing between said parallel slats.

16. The assembly of claim 1 wherein said at least one cord collector is located adjacent said top rail, with said cord extending to said bottom rail and affixed to said bottom rail.

17. The assembly of claim 1 wherein said cord collector is located adjacent said bottom rail, said cord extending to said top rail and affixed to said top rail.

18. The assembly of claim 1 wherein said cord collector includes a spool, said spool adapted to collect said cord thereon when said spool rotates.

19. The assembly of claim 18 wherein each of said at least two biasers includes a helical spring having a first fixed end and a second end coupled to at least one of said spools, such that rotation of said spools causes deformation of said helical springs and causes said springs to bias said spools toward collection of said cords thereon.

20. The assembly of claim 19 wherein each said helical spring is coupled to a common post with one of said spools, with said common post located concentrically through said spring and said spool.

21. The assembly of claim 20 wherein said spool is coupled to a spool gear, said progressive resister coupled to a resistance gear, said spool gear and said resistance gear meshed together such that rotation of said spool gear requires rotation of said resistance gear, and rotation of said resistance gear requires rotation of said spool gear.

22. The assembly of claim 1 wherein said cord collector includes a spool coupled to a spool gear, wherein said progressive resister is coupled to a resistance gear, said resistance gear and said spool gear meshed together, said key compressing a spring against a plate abutting said resistance gear with a progressively greater force when said spool progressively rotates to release progressively more of said cord from said spool.

23. The assembly of claim 1 wherein a cord redirector is coupled to said rail having said cord collector adjacent thereto, said cord redirector adapted to redirect said cord from a first direction parallel with said rail adjacent said cord collector to an orientation substantially perpendicular to said rail adjacent said cord collector.

24. The assembly of claim 23 wherein said assembly includes a cord tensioner spaced from said cord collector and abutting said cord with sufficient friction between said tensioner and said cord to maintain said cord in tension between said tensioner and said cord collector.

25. The assembly of claim 24 wherein said cord redirector includes a pulley, said pulley rotatably supported by said rail adjacent said cord collector.

26. A movable light occluding structure for a window, the structure comprising in combination:

a window covering;

a top rail at an upper end of said window covering, said top rail adapted to be attached to a casing adjacent a window;

a bottom rail at a lower end of said window covering;

a cord;

a cord collector, said cord collector coupled to one of said rails;

said cord extending between said cord collector and one of said rails spaced from said cord collector;

a biaser coupled to said cord collector, said biaser adapted to bias said cord collector toward having more cord collected with said cord collector;

a progressive resister coupled to said cord collector;

said progressive resister adapted to provide progressively greater resistance to motion by said cord collector when a progressively greater amount of cord is off of said cord collector;

wherein said cord collector is adapted to rotate, said progressive resister adapted to provide resistance to rotation of said cord collector; and wherein said progressive resister includes a brake which exerts progressively greater braking force when progressively greater amounts of cord are off of said cord collector.

27. The apparatus of claim 26 wherein said progressive resister is adapted to provide a common amount of resistance to motion of said cord collector in both a cord collecting direction and a cord release direction.

28. The apparatus of claim 26 wherein said cord collector includes a spool with at least a portion of said cord wrapped around said spool.

29. A movable light occluding structure for a window, the structure comprising in combination:

a window covering;

a top rail at an upper end of said window covering, said top rail adapted to be attached to a casing adjacent a window;

a bottom rail at a lower end of said window covering;

a cord;

a cord collector, said cord collector coupled to one of said rails;

said cord extending between said cord collector and one of said rails spaced from said cord collector;

a biaser coupled to said cord collector, said biaser adapted to bias said cord collector toward having more cord collected with said cord collector;

a progressive resister coupled to said cord collector;

said progressive resister adapted to provide progressively greater resistance to motion by said cord collector when a progressively greater amount of cord is off of said cord collector; and wherein said progressive resister includes a brake which exerts progressively greater braking force when progressively greater amounts of cord are off of said spool.

30. The apparatus of claim 29 wherein said brake of said progressive resister acts directly upon said spool.

31. The apparatus of claim 29 wherein said spool includes a spool gear coupled thereto, and wherein said progressive resister includes a resistance gear thereon, said resistance gear and said spool gear meshed together such that rotation of said spool gear requires rotation of said resistance gear and rotation of said resistance gear requires rotation of said spool gear, and wherein said brake acts upon said resistance gear.

32. The apparatus of claim 31 wherein said progressive resister includes a threaded shaft coupled to said resistance gear, a bottom plate abutting said resistance gear with said threaded shaft passing through said bottom plate, a top plate spaced further from said resistance gear than said bottom plate, said top plate coupled to said threaded shaft, said top plate adapted to move toward said bottom plate when said threaded shaft rotates in a direction corresponding with removal of said cord off of said spool coupled to said spool gear and meshed with said resistance gear coupled to said threaded shaft, and a spring interposed between said top plate and said bottom plate, such that movement of said top plate toward said bottom plate compresses said spring and exerts a progressively greater force upon said bottom plate pushing said bottom plate against said resistance gear.

33. The apparatus of claim 32 wherein said top plate includes a key coupled thereto, said key including a threaded hole with a pitch matching a pitch of threads on said threaded shaft, said top plate including arms thereon adapted to prevent said top plate from rotating, such that when said threaded shaft rotates, said key and said top plate resist rotation and are translated along said threaded shaft and translated relative to said bottom plate and said resistance gear.

34. A window covering assembly, comprising in combination:

a window covering;

a top rail at an upper end of said window covering, said top rail adapted to be attached to a casing adjacent a window;

a bottom rail at a lower end of said window covering;

a cord;

a cord collector, said cord collector coupled to one of said rails;

said cord extending between said cord collector and one of said rails spaced from said cord collector;

a spring coupled to said cord collector, said spring adapted to bias said cord collector toward having more cord collected with said cord collector;

a progressive resister coupled to said cord collector;

said progressive resister adapted to provide more resistance to motion by said cord collector when a lesser amount of cord is collected by said cord collector than when a greater amount of cord is collected by said cord collector; and a cord tensioner adjacent said cord, said cord tensioner adapted to maintain tension of said cord adjacent said cord collector.

35. The assembly of claim 34 wherein a cord redirector is coupled to said rail having said cord collector adjacent thereto, said cord redirector adapted to redirect said cord from a first direction parallel with said rail adjacent said cord collector to an orientation substantially perpendicular to said rail adjacent said cord collector.

36. The assembly of claim 35 wherein said cord collector is coupled to said top rail, said progressive resister is located adjacent said top rail, said spring is located adjacent said top rail, said cord redirector is located adjacent said top rail, and said cord extends down to and is affixed to said bottom rail.

37. The assembly of claim 35 wherein said cord collector is coupled to said bottom rail, said progressive resister is located adjacent said bottom rail, said spring is located adjacent said bottom rail, said cord redirector is located adjacent said bottom rail, and said cord extends up from said bottom rail to said top rail where said cord is affixed to said top rail.

38. The assembly of claim 37 wherein said cord redirector includes a pulley with said cord routed around said pulley, said cord extending horizontally parallel with said bottom rail between said cord collector and said pulley and substantially vertically perpendicular to said bottom rail on a side of said pulley opposite said cord collector.

39. A window covering assembly, comprising in combination:

a window covering;

a top rail at an upper end of said window covering, said top rail adapted to be attached to a casing adjacent a window;

a bottom rail at a lower end of said window covering;

a cord;

a cord collector, said cord collector coupled to one of said rails;

said cord extending between said cord collector and one of said rails spaced from said cord collector;

a spring coupled to said cord collector, said spring adapted to bias said cord collector toward having more cord collected with said cord collector;

a progressive resister coupled to said cord collector;

said progressive resister adapted to provide more resistance to motion by said cord collector when a lesser amount of cord is collected by said cord collector than when a greater amount of cord is collected by said cord collector; and wherein a cord tensioner is located adjacent a pulley, said cord tensioner adapted to maintain tension of said cord between said pulley and said cord collector.

40. The assembly of claim 39 wherein said cord tensioner includes a resilient finger adapted to press against said cord as said cord rounds said pulley.

41. A window covering apparatus, comprising in combination:

a window covering;

a top rail at an upper end of said window covering, said top rail including means to attach said top rail to a casing adjacent the window;

a bottom rail at a lower end of said window covering;

a cord;

a means to collect cord coupled to one of said rails;

said cord extending between said cord collecting means and one of said rails spaced from said cord collecting means;

a means to bias said cord collecting means toward having more cord collected with said cord collecting means;

a progressive resister coupled to said cord collecting means;

said progressive resister including means to provide progressively greater resistance to motion by said cord collecting means when a progressively greater amount of said cord is off of said cord collecting means; and said means to provide progressively greater resistance includes a brake adapted to exert a progressively greater braking force at least indirectly upon said collecting means to resist further collection of cord a progressively greater amount as progressively more cord is off of said cord collecting means.

42. The apparatus of claim 41 wherein said cord collecting means includes a spool having at least a portion of said cord wrapped around said spool, said spool adapted to rotate relative to said rail adjacent said cord collecting means.

43. The apparatus of claim 42 wherein said means to bias said cord collecting means includes a spring coupled to said spool.

44. A window covering apparatus comprising in combination:

a window covering;

a top rail at an upper end of said window covering, said top rail including means to attach said top rail to a casing adjacent the window;

a bottom rail at a lower end of said window covering;

a cord;

a means to collect cord coupled to one of said rails;

said cord extending between said cord collecting means and one of said rails spaced from said cord collecting means;

a means to bias said cord collecting means toward having more cord collected with said cord collecting means;

a progressive resister coupled to said cord collecting means;

said progressive resister including means to provide progressively greater resistance to motion by said cord collecting means when a progressively greater amount of said cord is off of said cord collecting means; and wherein said means to provide progressively greater resistance includes a brake which exerts progressively greater braking force at least indirectly upon said spool to resist further rotation of said spool a progressively greater amount as progressively more of said cord is off of said spool.

* * * * *